US005097975A

United States Patent [19]

Waterston et al.

[11] Patent Number: 5,097,975

[45] Date of Patent: Mar. 24, 1992

[54] RECYCLABLE MATERIALS CADDY FOR HANGING ATTACHMENT TO A WASTE RECEPTACLE

[75] Inventors: Rebecca L. Waterston, Plymouth; Mark S. Stoll, Deephaven, both of Minn.

[73] Assignee: Liberty Diversified Industries, New Hope, Minn.

[21] Appl. No.: 644,509

[22] Filed: Jan. 23, 1991

Related U.S. Application Data

[63] Continuation-in-part of Ser. No. 543,944, Jun. 26, 1990.

[51] Int. Cl.[5] ..... B65D 21/02

[52] U.S. Cl. ..... 220/23.83; 220/23.86; 220/DIG. 13; 220/482; 206/806; 229/117.09; 229/117.21; 229/164

[58] Field of Search ..... 229/117.09, 117.21, 229/164; 220/23.83, 23.80, DIG. 13, 482, 23.4; 206/44.11, 806

[56] References Cited

U.S. PATENT DOCUMENTS

| | | | |
|---|---|---|---|
| 403,535 | 5/1989 | Johnson | 220/482 |
| 1,888,127 | 11/1932 | Hearne | 220/482 |
| 2,339,112 | 1/1944 | Roberts et al. | 206/44.11 |
| 2,770,513 | 11/1956 | Brown | 220/482 |
| 2,980,281 | 4/1961 | Stewart | 220/482 |
| 3,341,271 | 9/1967 | Nelson | 206/44.11 |
| 3,951,486 | 4/1976 | Tracy | 220/482 |

FOREIGN PATENT DOCUMENTS 701617 1/1941 Fed. Rep. of Germany ... 220/DIG. 13

OTHER PUBLICATIONS

Catalogue Hold Everything 12/1989 p. 5 Item No. 5.

*Primary Examiner*—Joseph Man-Fu Moy
*Attorney, Agent, or Firm*—Moore & Hansen

[57] ABSTRACT

A caddy for recyclable paper materials constructed from a linear blank of double-faced corrugated plastic sheet material such as polyethylene, with a metal hanger member allowing the caddy to be mounted in hanging relation to the rim of a conventional wastebasket. The caddy includes an open top, with a higher rear wall, lower front wall, and convexly curved side walls. The ends of the hanger member are received between a rear panel and a rear foldover panel which are hingedly connected and folded into parallel abutting contact to form the rear wall, and the central portion of the hanger member extends upwardly and rearwardly through a slit formed between those panels. The front and rear foldover panels are shortened, and the front foldover panel is held in place by a pair of side struts extending from front to rear along the side walls of the caddy. The blank is oriented on the corrugated plastic sheet material such that longer or major axis of the rectangle bounding the blank is parallel with the longitudinal grain of the corrugated plastic sheet material.

23 Claims, 3 Drawing Sheets

RECYCLABLE MATERIALS CADDY FOR HANGING ATTACHMENT TO A WASTE RECEPTACLE

This application is a continuation-in-part of co-pending U.S. Patent Application Ser. No. 07/543,944 field on June 26, 1990, still pending.

BACKGROUND OF THE INVENTION

This invention relates generally to receptacles and containers for recyclable waste paper, and particularly to a caddy folded from a blank of corrugated polyethylene for hanging attachment on the outside rim of a conventional wastebasket or the two-bag tote container disclosed herein.

The state of the prior art and numerous deficiencies thereof are discussed in detail in the above referenced parent application, the disclosure and content of the file history of which is incorporated herein by reference.

The recyclable materials caddy disclosed herein provides certain improvements and advantages relative to the double-walled recyclable materials caddy having side walls with angled top edges as disclosed in the above parent application.

The caddy having side walls with angled top edges provides significant structural reinforcement for the supporting panels, but incorporates a somewhat complicated and sometimes cumbersome system of fastening tabs to secure the panels in place. The caddy does effectively utilize the system of fastening tabs for dual purposes, however, such as providing positive pressure to clamp the tabs and panels in position while also disposing closed double-fold edges along the top of the front wall, rear wall, and side walls. This accomplishment is particularly significant due to top edges of the side walls being angled to permit a higher rear wall and lower front wall.

In addition, the caddy having side walls with angled top edges is necessarily formed with a blank that extends horizontally across a fabricated sheet of double-faced corrugated plastic, with the major axis of the blank extending perpendicular to the longitudinal grain of the corrugated plastic sheet material. However, the length of the blank along the major axis is approximately thirty inches and represents approximately two thirds of the standard width of the sheet material as fabricated, therefore consuming a disproportionate amount of the sheet material and producing a high percentage of waste.

The panels and folds of the caddy are subject to stress produced by the memory of the corrugated plastic sheet material that tend to urge the folded blank to return to its generally planar form, and the the caddy therefore requires deeper score lines to minimize the effect of memory and double score lines to make certain folds and panel orientations possible.

BRIEF SUMMARY OF THE INVENTION

It is therefore one object of this invention to design an improved caddy for recyclable waste paper materials that may be mounted in stable, hanging attachment on the rim of a conventional wastebasket.

It is another object of this invention to design the above caddy so as to reorient the blank on the fabricated sheet material such that the major axis of the blank is parallel with the longitudinal grain of the corrugated plastic sheet material, with the length of the minor axis being such that an integer multiple of two or more blanks may be disposed side-by-side on a standard width of fabricated sheet material, thereby significantly reducing wastage of the sheet material.

It is an additional object of this invention to design the above caddy such that the total area of a rectangle bounding the blank and representing the maximum amount of sheet material consumed by the caddy is reduced from that of prior designs, the reduction in the case of the preferred embodiment disclosed herein being on the order of approximately six to seven percent.

It is yet another object of this invention to design the above caddy such that the top edges of the side walls ma be formed from single exposed cut edges of the corrugated plastic sheet material, but will be curved to prevent the exposed edges from cutting the user or catching on waste materials.

It is a further object of this invention to design the above caddy such that the front and rear foldover flaps forming the closed top edges of the front and rear walls extend only partially along the height of the front and rear walls, and such that each of the front and rear foldover flaps are held in place by common struts extending along the side walls of the folded caddy.

It is a related object of this invention to design the above caddy such that it incorporates a system of fastening tabs that requires less force and manual manipulation of the panels to secure the caddy in the folded configuration and unsecure the tabs and unfold the caddy when desired.

It is one more object of this invention to design the above caddy such that it requires fewer score lines and fewer double-scored fold lines in particular, and such that the stresses exerted on the panels across the fold lines are reduced so that the caddy is more inclined to remain in its folded configuration with less force being exerted by the system of securing fasteners.

It is yet another object of this invention to design the above caddy such that it permits installation of the hanger member subsequent to folding and securing the body of the caddy in its upright configuration, and permits replacement or interchanging of the hanger member with other hanger members without unfolding the body of the caddy.

Briefly described, the caddy for recyclable paper materials is constructed from a linear blank of double-faced corrugated plastic sheet material such as polyethylene, with a metal hanger member allowing the caddy to be mounted in hanging relation to the rim of a conventional wastebasket. The caddy includes an open top, with a higher rear wall, lower front wall, and convexly curved side walls. The ends of the hanger member are received between a rear panel and a rear foldover panel which ar hingedly connected and folded into parallel abutting contact to form the rear wall, and the central portion of the hanger member extends upwardly and rearwardly through a slit formed between those panels. The front and rear foldover panels are shortened, and the front foldover panel is held in place by a pair of side struts extending from front to rear along the side walls of the caddy. The blank is oriented on the corrugated plastic sheet material such that longer or major axis of the rectangle bounding the blank is parallel with the longitudinal grain of the corrugated plastic sheet material.

DESCRIPTION OF THE PREFERRED EMBODIMENT

The recyclable materials caddy of this invention is shown in FIGS. 1–7 and referenced generally therein by the numeral 10.

Figure 1:
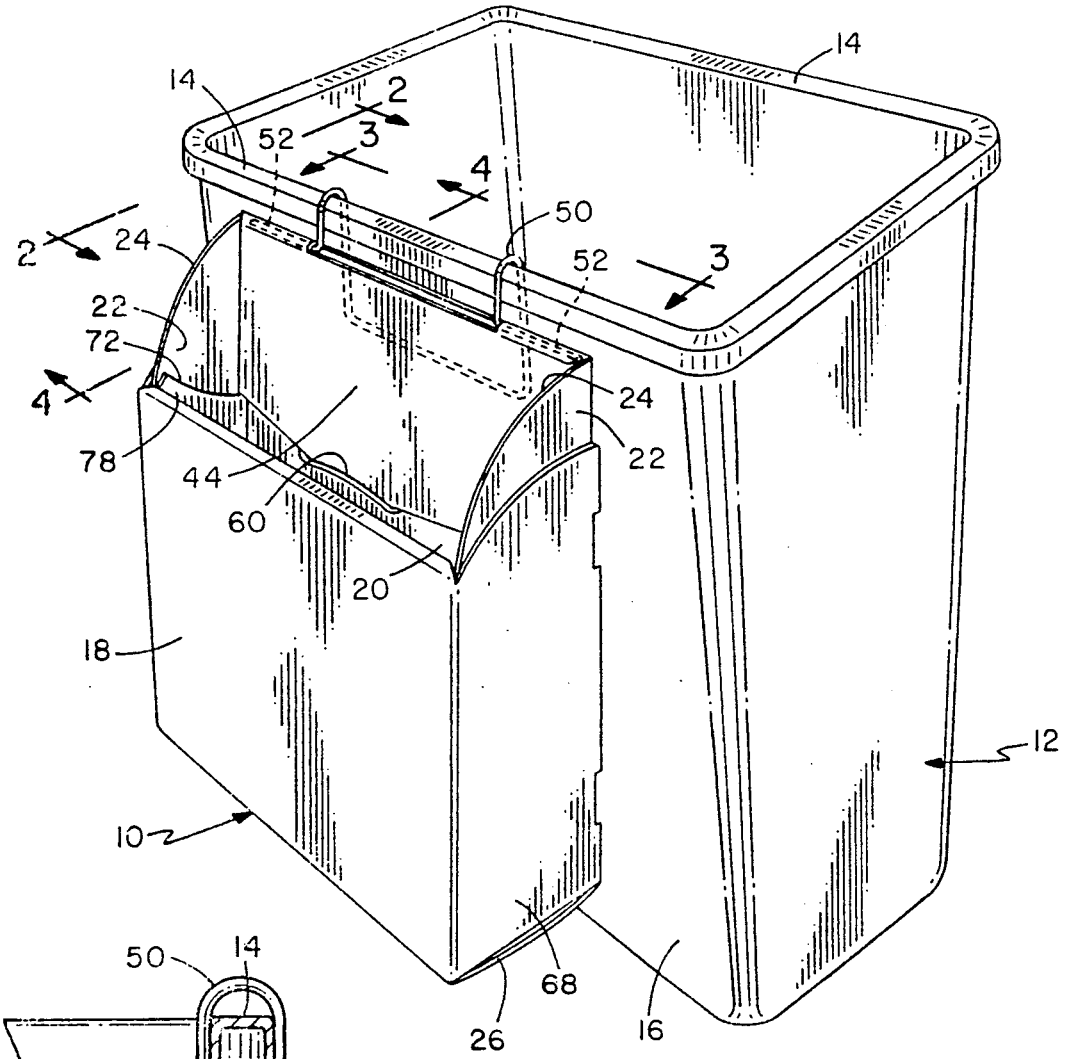
FIG. 1 is a front perspective view of the recyclable materials caddy of this invention in hanging attachment on a conventional wastebasket.
Figure 6:
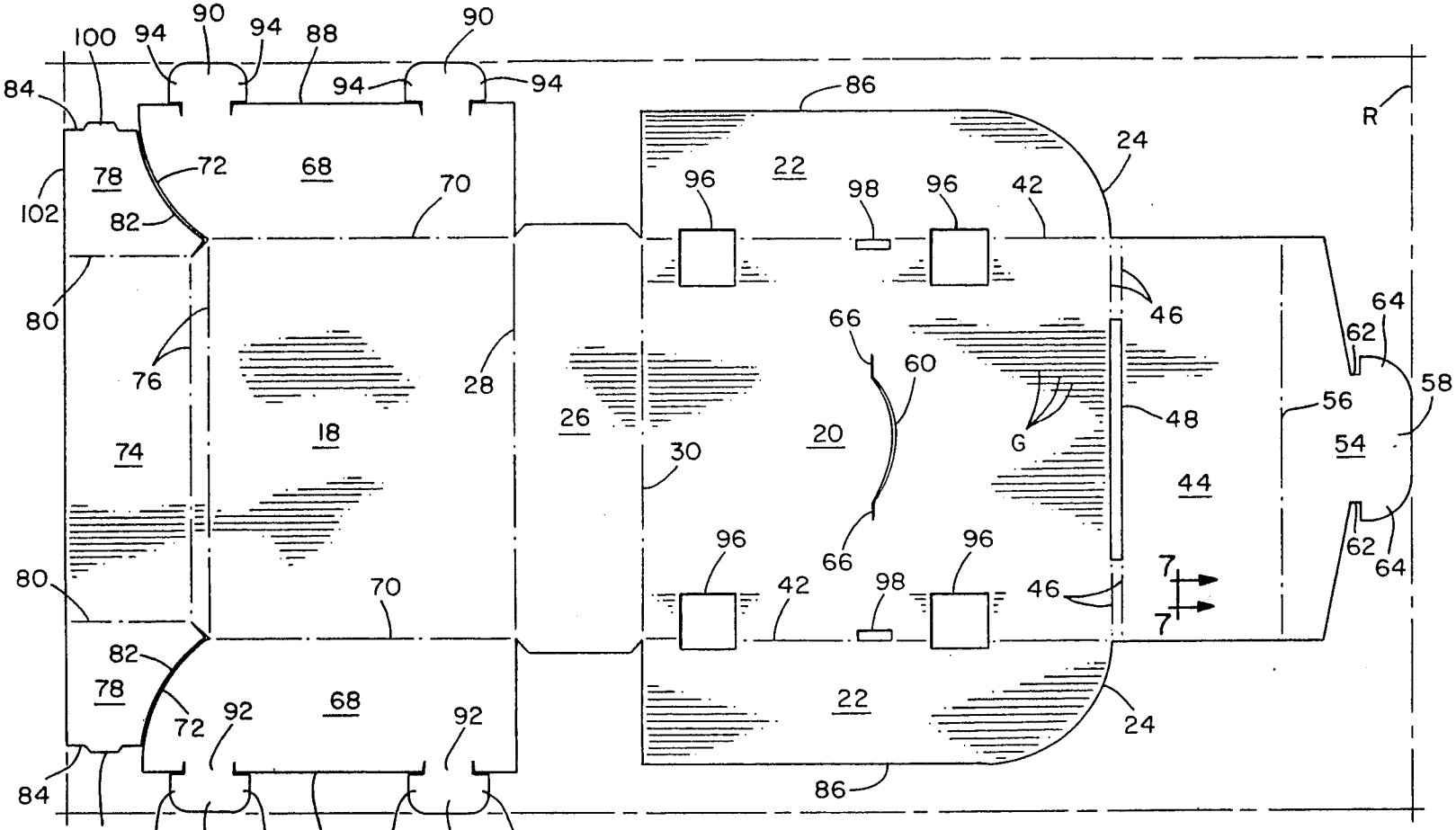
FIG. 6 is a top plan view of the blank used to construct the recyclable materials caddy of FIG. 1.

Referring particularly to FIGS. 1 and 6, it may be seen that the caddy 10 may be mounted in hanging attachment on a conventional wastebasket 12, the caddy 10 being hung from the top peripheral rim 14 of the wastebasket 12 and disposed in front of and in generally parallel abutting contact with the exterior side of the front wall 16 of the wastebasket 12.

The caddy 10 has a body which defines an open top receptable region and includes a generally rectangular front panel 18, a generally rectangular rear panel 20 having a height greater than the height of the front wall 18, a pair of spaced-apart inner side panels 22 having upwardly convexly curved top edges 24, and a generally rectangular bottom panel 26. The front panel 18 and rear panel 20 extend from and are hingedly connected along the bottom edges thereof to the opposing edges front and rear edges of of the bottom panel 26 along single-scored fold lines 28, 30, respectively. The side edges of the bottom panel 26 extend outwardly a distance approximately equal to the thickness of the corrugated plastic sheet material, with the edges thereof being generally angles or tapered at an approximately 45° angle relative to the single-scored fold lines 28, 30.

Figure 7:
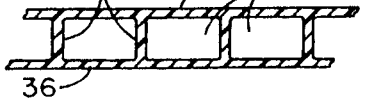
FIG. 7 is cross section detail view of the double faced corrugated plastic sheet material used to fabricate the blank of FIG. 6.

Referring to FIGS. 6 and 7, it may be seen that the caddy 10 is folded to an upright position from a generally planar blank 32 of plastic sheet material having a generally rectangular symmetric form. The preferred plastic sheet material is a double-faced corrugated polyethylene, the double-faced corrugated plastic sheet material having a pair of planar plies 34, 36 and a convoluted intermediate ply 38 forming a multiplicity of longitudinal air pockets 40 and a grain G extending parallel with the blank 32. The convoluted intermediate ply 38 is integrally formed with and thermally bonded to each of the planar plies 34, 36, and the convoluted intermediate ply 38 may melt together with the planar plies 34, 36 and take on the appearance of a multiplicity of laterally extending beams as shown in FIG. 7. The blank 32 is generally bounded by a rectangle R having a longer or major axis oriented generally parallel with the grain G of the double-faced corrugated plastic sheet material, the total area of the rectangle R bounding the blank 32 representing the maximum amount of sheet material consumed by the caddy 10. In the preferred embodiment shown in FIG. 6, the rectangle R has a major axis of $32\frac{3}{4}''$ and a minor axis of $18\frac{3}{4}''$, for a total area of approximately 606 square inches. This compares with a rectangle having a major axis of 30" and a minor axis of $21\frac{1}{2}''$ for a total area of approximately 645 square inches in the case of the blank disclosed in the above referenced co-pending United States Patent Application Serial No. 07/543,944.

Each inner side wall panel 22 extends from and is hingedly connected along the rear edge thereof to one of the opposing side edges of the rear panel 20 along a single-scored fold line 42. A generally rectangular rear foldover panel 44 extends from and is hingedly connected to the top edge of the rear panel 20 along double-scored fold lines 46, the central portion of the area between the double-scored fold lines 46 being cut away to form a generally rectangular slot 48 through which a metal hanger member 50 is received. The double-scored fold lines 46 are spaced apart greater than the diameter of the metal rod forming the hanger member 50, and sufficient that the portion between the double-scored fold lines 46 forms a generally planar top edge when the rear foldover panel 44 is folded into parallel abutting contact with the rear panel 20. The hanger member 50 may be formed in substantially the same manner as previously described in the above referenced co-pending U.S. Pat. Application Ser. No. 07/543,944, including a support section projecting rearwardly from the rear wall 20 of the caddy 10 and defining a depending engagement section, with the modification that the distal ends 52 of the hanger member 50 may be shortened from the length utilized with the caddy 10 disclosed therein.

A rear flap 54 extends from and is hingedly connected to the bottom edge of the rear foldover panel 44 along a single-scored fold line 56, with a rear securing tab 58 extending from the tapered bottom edge of the rear flap 54. The rear panel 20 defines a generally arcuate, upwardly convex slit 60 extending completely therethrough, the slit 60 oriented generally horizontally and being positioned at a height on the rear panel 20 such that indents 62 separating the rear flap 54 from the ears 64 of the rear securing tab 58 are engagingly received within the straight side extensions 66 of the slit 60 when the rear foldover flap 44 is folded forwardly into the interior of the caddy 10 and into parallel abutting contact with the rear panel 20 so that the rear securing tab 58 is inserted through and received within the slit 60.

A pair of outer side walls 68 extend from and are hingedly connected to one of the opposing side edges of the front panel 18 along single-scored fold lines 70, each outer side wall 68 having upwardly convexly curved top edges 72. A front foldover panel 74 extends from and is hingedly connected to the top edge of the front panel 18 along a pair of double-scored fold lines 76. The double-scored fold lines 76 are spaced apart greater than the thickness of the double faced corrugated plastic sheet material, and sufficient that the portion disposed between the double-scored fold lines 76 forms a generally planar top edge when the front foldover panel 74 is folded into parallel abutting contact with the front panel 18. The ends of the portion between the double-scored fold lines 76 are angled at an approximately 45° angle extending inwardly toward the centerline of the blank 32 from the front panel 18 to the front foldover panel 74.

A pair of side struts 78 extend from and are hingedly connected to one of the opposing side edges of the front foldover panel 74 along single-scored fold lines 80. Each side strut 78 has a concavely curved top edge 82 closely confronting and mating with the top edge 72 of the adjacent outer side panel 68 when the blank 32 is laid flat. Each side strut 78 has a length measured between the outer or rear edge 84 and the corresponding single-scored fold line 80, the length being generally equal to the width of the adjacent inner side panel 22 measured between the outer or rear edge 86 thereof and the single-scored fold line 42 separating the inner side panels 22 from the rear panel 20.

Extending from and flexibly connected to each of the outer side panels 68 generally adjacent to the outer or rear edge 88 thereof are a pair of side securing tabs 90, each pair of side securing tabs 90 being spaced apart such that one side securing tab 90 is disposed generally adjacent to the top of the front panel 18 while the opposing side securing tab 90 is disposed generally adjacent to the bottom of the front panel 18. Each side securing tab 90 has a stem portion 92 defined by two straight parallel cuts in the rear edges 88 of the outer side panels 68, and a pair of ears 94 disposed on opposing sides of the generally rectangular stem portion 92.

The rear panel 20 defines four generally rectangular apertures 96 extending entirely therethrough, the apertures 96 being disposed along and overlapping the side edges and single-scored fold lines 42 between the rear panel 20 and the inner side panels 22, each aperture 96 being spaced apart from the single-scored fold line 30 between the rear panel 20 and bottom panel 26 a distance corresponding to the position of one of the side securing tabs 90. Each aperture 96 has a height approximately equal to the width of the stem portion 92 of the corresponding side securing tab 90 measured between the parallel cuts in the outer side panels 68, and a width approximately equal to the length of the corresponding side securing tab 90 measured from the rear edge 88 of the adjacent outer side panel 68.

The rear panel 20 similarly defines two generally rectangular narrow apertures 98 extending entirely therethrough, the apertures 98 being disposed parallel with and adjacent to the side edges and single-scored fold lines 42 between the rear panel 20 and the inner side panels 22, each aperture having a width approximately equal to or slightly greater than the thickness of the corrugated plastic sheet material, and each aperture 98 being spaced apart from the single-scored fold line 30 between the rear panel 20 and bottom panel 26 a distance corresponding to a position along one of the rear edges 84 of the corresponding side strut 78. A pair of strut locking tabs 100 extend from and are connected to the side struts 78 along the rear edge 84 thereof, each of the strut locking tabs 100 being received within one of the narrow apertures 98 when the front foldover panel 74 is folded into parallel abutting contact with the front panel 18 and the side struts 78 extend rearwardly from the front foldover panel 74 toward the rear panel 20 parallel with the inner side panels 22.

It should be noted that the side struts 78 each have height measured from the outermost of the double-scored fold lines 76 and the bottom edge 102 of the front foldover panel 74 sufficient that each strut locking tab 100 is disposed below or beneath the upper side securing tab 90 when the front foldover panel 74 is folded into parallel abutting contact with the front panel 18 and the side struts 78 extend rearwardly from the front foldover panel 74 toward the rear panel 20 parallel with the inner side panels 22. Each strut securing tab 100 has a pair of tapered side edges to permit easy insertion into the corresponding narrow aperture 98.

When the blank 32 is folded into the upright form of the caddy 10 shown in FIG. 1, the inner side panels 68 and outer side panels 22 combine to form side walls of the caddy 10, the front panel 18 and front foldover panel 74 combine to form a front wall, and the rear panel 20 and rear foldover panel 44 combine to form a rear wall.

In operation, one or more of the blanks 32 are cut and scored from the double-faced corrugated plastic sheet material. Each blank is then folded to and secured in the upright configuration as shown in FIGS. 1-5 and described below.

From the planar configuration shown in FIG. 6, the front foldover panel 74 is folded completely across the double scored fold lines 76 so that the front foldover panel 74 is in parallel abutting contact with the front panel 18. The side struts 78 are then folded upwardly across single-scored fold lines 80 until the side struts 78 are generally perpendicular to the front panel 18. The inner side panels 22 are then folded upwardly across single-scored fold lines 42 until the inner side panels 22 are generally perpendicular to the rear panel 20, and the outer side panels 68 may be folded upwardly across single-scored fold lines 70 to about an angle of approximately 45° relative to the front panel 18. The rear panel 20 and front panel 18 are then folded upwardly relative to the bottom panel 26 across single-scored fold lines 28, 30 until the front edges 86 of the inner side panels 22 are parallel with and contact the junction between the outer side panels 68 and front panel 18 along the single-scored fold lines 70. The strut locking tabs 100 are received within the narrow apertures 98 in the rear panel 20, and the outer side panels 68 are folded rearwardly into parallel abutting contact with the inner side walls 22 such that the outer side panels 68 are generally perpendicular to the front panel 18, and the inner side panels 22 are received between with the corresponding outer side panel 68 and side strut 78. Each of the side securing tabs 90 are folded rearwardly and inwardly around the rear edges of the caddy 10 formed by the junctions between the rear panel 20 and inner side panels 22, with the side securing tabs 90 each being pushed forcibly through a corresponding one of the larger rectangular apertures 96 in the rear panel 20. The ears 94 of the side securing tabs 90 will bend rearwardly as the side securing tabs 90 are pressed through the apertures 96, and will then spring back to a position generally parallel with the stem portion 92 of the side securing tabs 90 when the side securing tabs 90 and ears 94 are completely received within the interior region of the caddy 10 and disposed in front of the rear panel 20. The side securing tabs 90 may then be allowed to spring rearwardly, or may be forcibly pressed rearwardly, until the side securing tabs 90 are generally parallel with the rear panel 20 and the ears 94 of each side securing tab 90 are in parallel abutting contact with the front surface of the rear panel 20 above and below each aperture 96, as shown particularly in FIGS. 3-5. The hanger member 50 may then be inserted through the slot 48. The rear foldover panel 44 is then folded forwardly across the double-scored fold lines 46, with the rear flap 54 being folded across single-scored fold line 56 to an angle of approximately 90° or sufficient that the distal edge of the rear securing tab 58 has clearance above the top edge of the front wall defined by the portion between double-scored fold lines 76. The portion of the rear wall 20 disposed directly beneath the slit 60 may then be pressed forwardly to open the slit 60, and the distal edge of the rear securing tab 58 is inserted through the slit 60. The rear flap 54 and rear foldover panel 44 are pressed rearwardly toward the rear panel 20, thereby forcing the rear securing tab 58 downwardly and entirely through the slit 60 such that the indents 62 receive the rear panel 20 adjacent to the straight side edges of the slit 60 and the ears 64 of the rear securing tab 58 are engaged behind the rear panel 20. The caddy 10 is thereby folded and secured in the upright position, and may be unfolded or disassembled by reversing the process.

Figure 2:
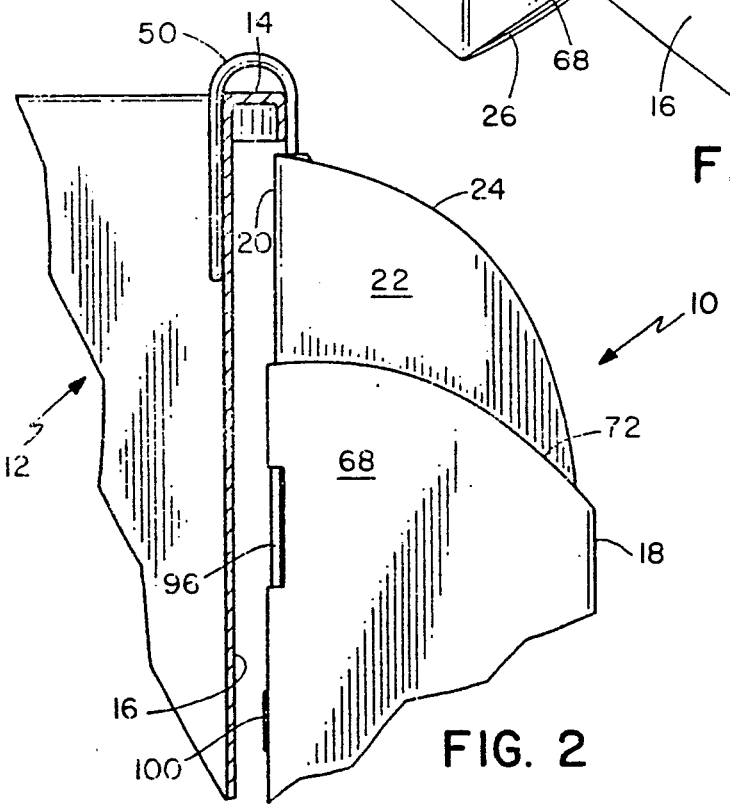
FIG. 2 is a partial side section view of the recyclable materials caddy and wastebasket taken through line 2—2 of FIG. 1.
Figure 3:
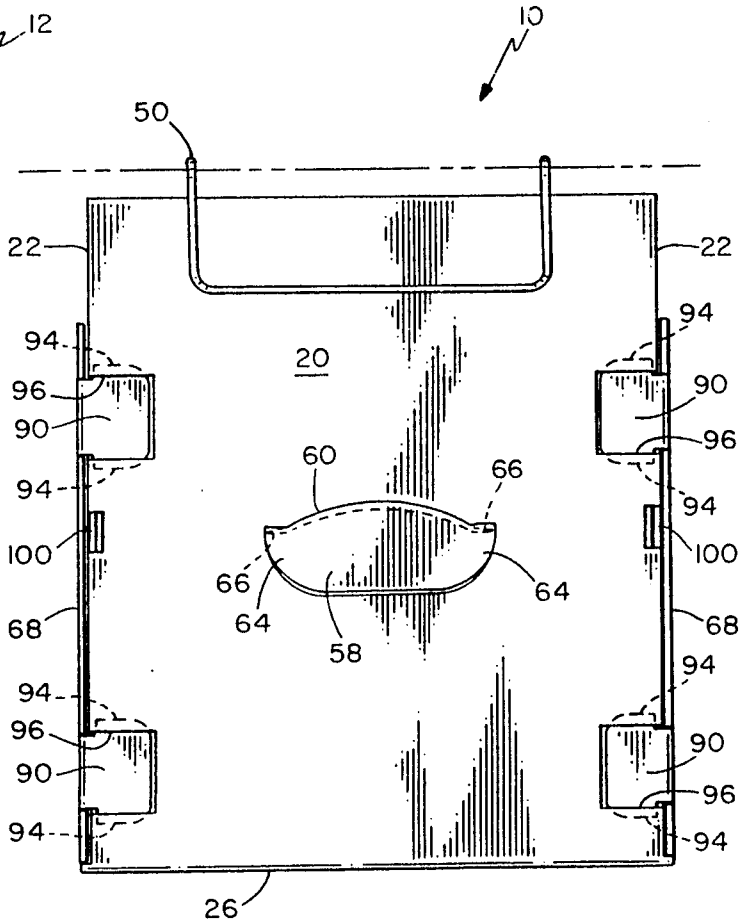
FIG. 3 is a partially rear elevation view the recyclable materials caddy of FIG. 1 taken from line 3—3 of FIG. 1.
Figure 4:
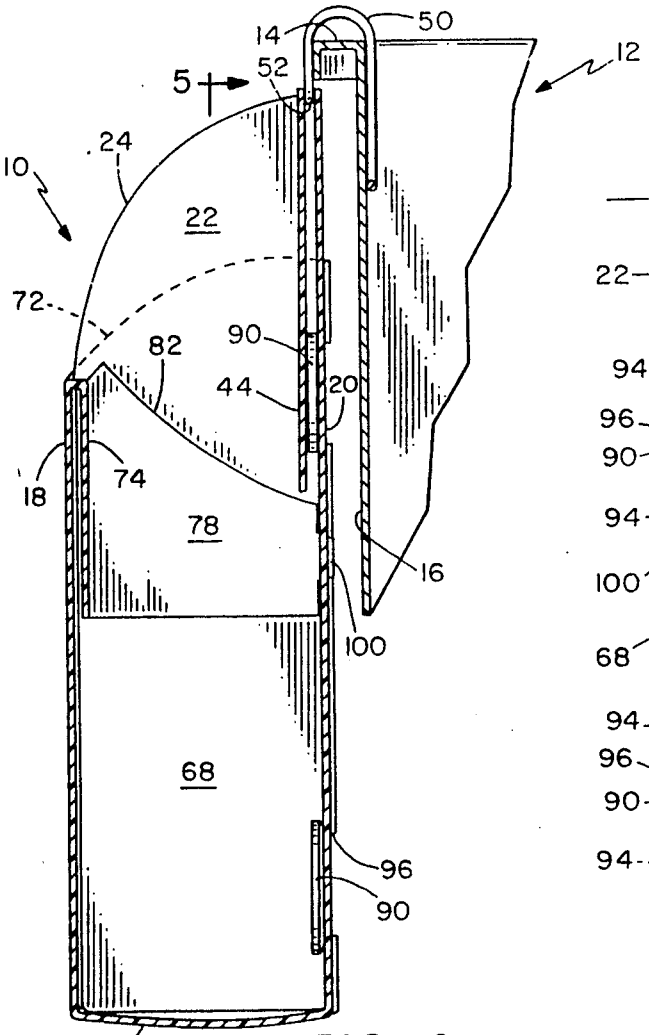
FIG. 4 is a side elevation cross section view of the recyclable materials caddy of FIG. 1 taken through line 4—4 of FIG. 1.
Figure 5:
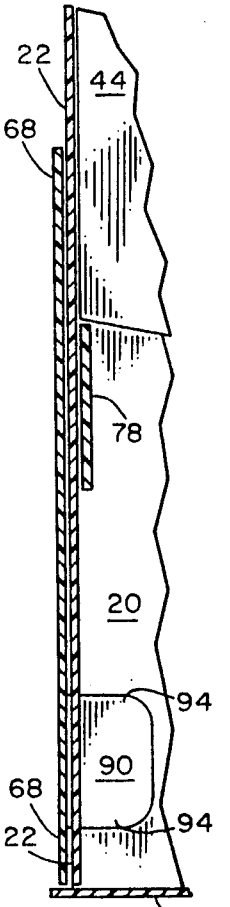
FIG. 5 is a partially broken away rear elevation cross section view of the recyclable materials caddy of FIG. 1 taken through line 5—5 of FIG. 4.

The caddy 10 may then be mounted in a stable, hanging attachment on the rim 14 of a conventional wastebasket 12 as shown particularly in FIGS. 1, 2, and 4. When waste materials (not shown) are being discarded by a user into the conventional wastebasket 12, recyclable waste materials such as predetermined types of paper may be selectively placed within the caddy 10 mounted on the wastebasket 12. The caddy 10 may later be removed from the wastebasket 12, and the recyclable waste materials discarded into a bin or carrier for processing or recycling.

While the preferred embodiment of the above recyclable materials caddy 10 and methods of using and constructing same have been described in detail above with reference to the attached drawing figures, it is understood that various changes and adaptations may be made without departing from the spirit and scope of the appended claims.

What is claimed is:

1. A caddy for mounting in hanging attachment on a rim of a wastebasket, said caddy comprising:

a caddy body, said caddy body being folded to an upright configuration from a blank, said blank being cut and scored from a generally planar corrugated sheet material, said caddy body including a generally rectangular front wall having a height, a generally rectangular rear wall having a height greater than said height of said front wall, a pair of side walls connected to and extending between said front wall and said rear wall, each of said pair of side walls being spaced apart and having a generally arcuately curved top edge, and a generally rectangular bottom wall, said caddy body defining an open top receptacle region; and a hanger member, said hanger member defining a support section projecting rearwardly from said rear wall of said caddy body and defining a depending engagement section, said hanger member being attached to said caddy body such that said caddy body may be mounted in hanging attachment on the rim of the wastebasket.

2. The caddy of claim 1 wherein the blank comprises:

a front panel, said front panel having a pair of opposing side edges, a top edge, and a bottom edge, said front panel having a first height;

a bottom panel, said bottom panel having a front edge and a rear edge, said bottom panel being hingedly connected to said bottom edge of said front panel;

a rear panel, said rear panel having a top edge and a bottom edge and a pair of opposing side edges, said rear panel being hingedly connected to said bottom panel along the rear edge thereof, said rear panel having a second height greater than said first height of said front panel;

a pair of inner side panels, each of said pair of inner side panels being hingedly connected to said rear panel along a one of said pair of opposing side edges thereof, each of said pair of inner side panels having a bottom edge;

a pair of outer side panels, each of said pair of outer side panels being hingedly connected to said front panel along a one of said pair of opposing side edges thereof, each of said pair of inner side panels having a bottom edge;

a front foldover panel, said front foldover having a pair of opposing side edges, said front foldover panel being hingedly connected to said front panel along said top edge thereof, said front foldover panel being pivoted to a position generally parallel with said front panel when the caddy is folded to the upright configuration; and a pair of side struts, each of said pair of side struts being hingedly connected to said front foldover panel along a one of said pair of opposing side edges thereof, each of said pair of side struts extending rearwardly generally parallel with said inner side panels and said outer side panels and contacting said rear panel when the caddy is folded to the upright configuration.

3. The caddy of claim 2 wherein the generally planar corrugated sheet material defines a longitudinal grain, and wherein the blank is bounded by a rectangle having a major axis, said major axis being aligned generally parallel with said longitudinal grain of the generally planar corrugated sheet material.

4. The caddy of claim 3 wherein the generally planar corrugated sheet material is double-faced corrugated polyethylene.

5. The caddy of claim 2 wherein each of the pair of outer side panels has a top edge, each said top edge of the pair of outer side panels being generally arcuately curved.

6. The caddy of claim 5 wherein the top edge of each of the outer side panels is upwardly convexly curved.

7. The caddy of claim 2 wherein each of the pair of inner side panels has a top edge, each said top edge of the pair of inner side panels being generally arcuately curved.

8. The caddy of claim 7 wherein the top edge of each of the inner side panels is upwardly convexly curved.

9. The caddy of claim 2 wherein each of the side struts defines a locking tab extending therefrom, and wherein the rear panel defines a pair of apertures, each of said pair of apertures being positioned such that one said locking tab is received therein when the caddy is folded to the upright configuration and the pair of side struts extend rearwardly generally parallel with the inner side panels and the outer side panels and contacting the rear panel.

10. The caddy of claim 2 wherein each of the outer side panels defines at least one side securing tab extending therefrom, and wherein the rear panel defines at least a pair of apertures extending therethrough, each of said apertures being positioned such that a corresponding side securing tab is engagingly received therethrough when the caddy is folded to the upright configuration.

11. The caddy of claim 10 wherein the rear panel has a rear surface, and further wherein each corresponding side securing tab is engagingly received through the one of the pair of apertures from said rear surface thereof.

12. A caddy for mounting in hanging attachment on a rim of a wastebasket, said caddy comprising:

a front panel, said front panel having a pair of opposing side edges, a top edge, and a bottom edge, said front panel having a first height;

a bottom panel, said bottom panel having a front edge and a rear edge, said bottom panel being hingedly connected to said bottom edge of said front panel;

a rear panel, said rear panel having a top edge and a bottom edge and a pair of opposing side edges, said rear panel being hingedly connected to said bottom panel along the rear edge thereof, said rear panel having a second height greater than said first height of said front panel;

a pair of inner side panels, each of said pair of inner side panels being hingedly connected to said rear panel along a one of said pair of opposing side edges thereof, each of said pair of inner side panels having a top edge and a bottom edge;

a pair of outer side panels, each of said pair of outer side panels being hingedly connected to said front panel along a one of said pair of opposing side edges thereof, each of said pair of inner side panels having a top edge and a bottom edge;

a front foldover panel, said front foldover having a pair of opposing side edges, said front foldover panel being hingedly connected to said front panel along said top edge thereof, said front foldover panel being pivoted to a position generally parallel with said front panel when the caddy is folded to the upright configuration;

a pair of side struts, each of said pair of side struts being hingedly connected to said front foldover panel along a one of said pair of opposing side edges thereof, each of said pair of side struts extending rearwardly generally parallel with said inner side panels and said outer side panels and contacting said rear panel when the caddy is folded to the upright configuration; and a hanger member, said hanger member defining a support section projecting rearwardly from said rear panel of the caddy and defining a depending engagement section, said hanger member being attached to said caddy such that said caddy may be mounted in hanging attachment on the rim of the wastebasket.

13. The caddy of claim 12 wherein the front panel, the rear panel, the bottom panel, the pair of inner side panels, the pair of outer side panels, and the front foldover panel are cut and scored from a corrugated sheet material in the form of a blank, said corrugated sheet material defining a longitudinal grain, and further wherein said blank is bounded by a rectangle having a major axis, said major axis being aligned generally parallel with said longitudinal grain of said corrugated sheet material.

14. The caddy of claim 12 wherein the top edge of each of the pair of inner side panels is generally arcuately curved.

15. The caddy of claim 14 wherein the top edge of each of the pair of inner side panels is upwardly convexly curved.

16. The caddy of claim 12 wherein the top edge of each of the pair of outer side panels is generally arcuately curved.

17. The caddy of claim 16 wherein the top edge of each of the pair of outer side panels is upwardly convexly curved.

18. A blank for a caddy, said caddy being mountable in hanging attachment on a rim of a wastebasket, said blank being cut and scored and folded to a generally upright configuration from a corrugated sheet material, said blank comprising:

a front panel, said front panel having a pair of opposing side edges, a top edge, and a bottom edge, said front panel having a first height measured between said bottom edge and said top edge thereof;

a bottom panel, said bottom panel having a front edge and a rear edge, said bottom panel being hingedly connected to said bottom edge of said front panel;

a rear panel, said rear panel having a top edge and a bottom edge and a pair of opposing side edges, said rear panel being hingedly connected to said bottom panel along the rear edge thereof, said rear panel having a second height measured between said bottom edge and said top edge thereof, said second height being greater than said first height of said front panel;

a pair of first side panels, each of said pair of first side panels being hingedly connected to said rear panel or said front panel along a one of said pair of opposing side edges thereof, each of said pair of first side panels having a top edge and a bottom edge;

a front foldover panel, said front foldover having a pair of opposing side edges, said front foldover panel being hingedly connected to said front panel along said top edge thereof, said front foldover panel being pivoted to a position generally parallel with said front panel when the blank is folded to the upright configuration;

a pair of side struts, each of said pair of side struts being hingedly connected to said front foldover panel along a one of said pair of opposing side edges thereof, each of said pair of side struts extending rearwardly generally parallel with said inner side panels and said outer side panels and contacting said rear panel when the blank is folded to the upright configuration.

19. The blank of claim 18 wherein each of the side struts defines a locking tab extending therefrom, and wherein the rear panel defines a pair of apertures, each of said pair of apertures being positioned such that one said locking tab is received therein when the caddy is folded to the upright configuration and the pair of side struts extend rearwardly generally parallel with the inner side panels and the outer side panels and contacting the rear panel.

20. The blank of claim 18 further comprising:

a hanger member, said hanger member being removably attachable to the caddy when the blank is folded to the generally upright configuration; and a rear foldover panel, said rear foldover panel being hingedly connected to the top edge of the rear panel and being foldable to a position in generally parallel contact with the rear panel, said rear foldover panel and the rear panel defining a slot extending therethrough, at least a portion of said hanger member being received through said slot and secured therein when said rear foldover panel is folded to said position in generally parallel contact with the rear panel.

21. The blank of claim 18 wherein the top edge of each of the pair of first side panels is generally upwardly convexly curved.

22. The blank of claim 18 further comprising:

a pair of second side panels, each of said pair of second side panels being hingedly connected to said front panel or said rear panel along a one of said pair of opposing side edges thereof, each of said pair of second side panels having a top edge and a bottom edge.

23. The blank of claim 22 wherein the top edge of each of the pair of second side panels is generally upwardly convexly curved.

* * * * *